US010870118B2

(12) United States Patent
Sekiya et al.

(10) Patent No.: US 10,870,118 B2
(45) Date of Patent: Dec. 22, 2020

(54) NOZZLE CAP, NOZZLE DEVICE PROVIDED WITH SUCH CAP, AND SPRAYING METHOD OF CHEMICAL SOLUTION

(71) Applicant: MAINTECH CO., LTD., Tokyo (JP)

(72) Inventors: Hiroshi Sekiya, Tokyo (JP); Tomohiko Nagatsuka, Fuji (JP); Toshikazu Hamaura, Sousa (JP)

(73) Assignee: MAINTECH CO., LTD., Tokyo (JP)

( * ) Notice: Subject to any disclaimer, the term of this patent is extended or adjusted under 35 U.S.C. 154(b) by 0 days.

(21) Appl. No.: 16/605,346

(22) PCT Filed: Jul. 12, 2018

(86) PCT No.: PCT/JP2018/026409
§ 371 (c)(1),
(2) Date: Oct. 15, 2019

(87) PCT Pub. No.: WO2019/017279
PCT Pub. Date: Jan. 24, 2019

(65) Prior Publication Data

US 2020/0122171 A1 Apr. 23, 2020

(30) Foreign Application Priority Data

Jul. 21, 2017 (JP) ..... 2017-142207

(51) Int. Cl.
*B05B 7/00* (2006.01)
*B05B 7/04* (2006.01)
(Continued)

(52) U.S. Cl.
CPC ..... *B05B 7/0475* (2013.01); *B05B 7/045* (2013.01); *B05D 1/02* (2013.01); *D21F 1/028* (2013.01)

(58) Field of Classification Search
CPC ..... B05B 7/00; B05B 7/045; B05B 7/0475; B05B 7/068
(Continued)

(56) References Cited

U.S. PATENT DOCUMENTS 318,930 A * 5/1885 Sutton ..... B05B 11/06 239/362
1,757,573 A * 5/1930 Heinrich ..... B05B 7/045 73/37
(Continued)

FOREIGN PATENT DOCUMENTS

JP S57-185751 U 11/1982
JP S63-005142 B2 2/1988
(Continued)

*Primary Examiner* — Viet Le
(74) *Attorney, Agent, or Firm* — Muncy, Geissler, Olds & Lowe, P.C.

(57) ABSTRACT

[Problem] To provide a nozzle cap that hardly causes clogging in the nozzle hole even when used for a long time, a nozzle device having such a nozzle cap and a spraying method of a chemical solution.

[Solution] The present invention relates to a nozzle cap 100 to be used for a nozzle device for spraying a chemical solution to wet paper, wire, felt, press rollers, dryer rollers, canvas or guide rollers in a paper machine, which is provided with: an air cap part 10 that is provided with a first base part 11 having a cylinder shape with a lid, with a nozzle hole 13 formed on the first base part 11; and a liquid cap part 20 that is provided with a second base part 21 having a disc-shape and a protruding part 22 that is formed on the second base part 21, and in this structure, a plurality of chemical solution spraying air holes 22*b* are formed on the second base part 21, and into a space part S formed between the first base part 11 and the second base part 21, with the first base part 11 and the second base part 21 being fitted to each other, a chemical solution is flowed from the protruding
(Continued)

part 22, and air is also flowed in from the chemical solution spraying air holes 22*b* so that the chemical solution from the nozzle holes 13 is sprayed by the air, and the lid part 11*a* has a lower surface having a plane shape so that the air flowed in from the chemical solution spraying air holes 22*b* are made to collide with the lower surface of the lid part 11*a* through the space part S.

8 Claims, 8 Drawing Sheets

(51) Int. Cl.
*B05D 1/02* (2006.01)
*D21F 1/02* (2006.01)

(58) Field of Classification Search
USPC ..... 239/418, 419, 423, 428
See application file for complete search history.

(56) References Cited

U.S. PATENT DOCUMENTS 2,042,746 A * 6/1936 Tracy ..... B05B 7/045 239/424
2,569,251 A * 9/1951 Nieburg ..... B05B 7/0491 239/8
2,577,550 A * 12/1951 Wahlin ..... B05B 7/045 239/424
2,645,527 A * 7/1953 Walters ..... B05B 7/066 239/430
2,930,532 A * 3/1960 Johnson ..... B05B 7/0815 239/335
3,096,023 A * 7/1963 Thomas ..... F16N 7/34 239/432
3,202,363 A * 8/1965 Kautz ..... B05B 7/1272 239/412
3,394,888 A * 7/1968 Dasse ..... B22C 23/02 239/424
3,463,395 A * 8/1969 Binoche ..... B05B 5/03 239/707
3,561,680 A * 2/1971 Ott ..... B05B 7/045 239/411
3,648,932 A * 3/1972 Ewald ..... B05B 7/0425 239/337
4,004,733 A * 1/1977 Law ..... B05B 5/043 239/3
4,125,225 A * 11/1978 Venghiattis ..... B05B 7/045 239/338
4,343,433 A * 8/1982 Sickles ..... B05B 7/068 239/3
4,787,404 A * 11/1988 Klosterman ..... B05B 7/045 134/102.2
4,989,789 A * 2/1991 Moruno ..... B05B 7/045 239/433
5,183,322 A * 2/1993 Haruch ..... B05B 1/16 239/394
5,294,057 A * 3/1994 Hamilton ..... B05B 1/3053 118/317
5,520,337 A * 5/1996 Fuchs ..... B05B 7/0031 239/343
6,082,637 A * 7/2000 Ludwig ..... B05C 5/02 138/112
6,116,521 A * 9/2000 Miyake ..... A01C 23/042 239/310
6,149,076 A * 11/2000 Riney ..... B05B 7/0861 239/135
6,250,567 B1 * 6/2001 Lewis ..... B05B 7/0408 239/292
6,422,827 B1 * 7/2002 Hara ..... B01F 5/0413 239/419
6,446,883 B1 * 9/2002 Huang ..... B05B 7/066 239/424
6,951,310 B2 * 10/2005 Anderson ..... B05B 7/0861 239/427
7,051,954 B2 * 5/2006 Gerstner ..... B05B 7/0815 239/296
7,156,320 B2 * 1/2007 Wang ..... B05B 7/0087 239/128
7,163,160 B2 * 1/2007 Liu ..... B05B 7/066 239/290
7,237,730 B2 * 7/2007 Prociw ..... F23D 11/107 239/403
7,708,208 B1 * 5/2010 Scheer ..... B05B 7/0408 239/1
7,721,976 B2 * 5/2010 Nolte ..... B05B 3/1014 239/222.11
7,757,964 B2 * 7/2010 Hansson ..... B05B 7/025 239/110
7,886,990 B2 * 2/2011 Scheer ..... F23D 11/38 239/290
9,441,870 B2 * 9/2016 Nikkanen ..... F25C 3/04
9,446,422 B2 * 9/2016 Jones ..... B05B 1/14
9,498,787 B2 * 11/2016 Ishizuka ..... A62C 35/11
9,580,344 B2 * 2/2017 Charbonneau ..... F23D 14/64
9,670,616 B2 * 6/2017 Raines ..... B65H 23/022
10,369,579 B1 * 8/2019 Badovick ..... B05B 7/061
10,478,850 B2 * 11/2019 Schwarz ..... B05B 5/1683
2002/0030122 A1 * 3/2002 Barnes ..... B05B 7/0075 239/423
2003/0044528 A1 * 3/2003 Tanno ..... A61K 9/1676 427/212
2009/0025425 A1 * 1/2009 Weinhold ..... B05B 7/045 65/21.2
2010/0116900 A1 * 5/2010 Wurz ..... F23D 11/102 239/8
2011/0147491 A1 * 6/2011 Pope ..... B05B 7/045 239/398
2012/0325932 A1 * 12/2012 Tani ..... B05B 7/0075 239/398
2013/0320112 A1 * 12/2013 Honeyands ..... B05B 7/045 239/424
2013/0323089 A1 * 12/2013 Han ..... F04F 5/463 417/176
2014/0110504 A1 * 4/2014 Honeyands ..... B05B 7/10 239/418
2015/0028132 A1 * 1/2015 Vidusek ..... B01D 53/80 239/403
2015/0165456 A1 * 6/2015 Shih ..... B05B 7/068 239/418
2015/0240419 A1 * 8/2015 Sekiya ..... D21H 23/50 239/296
2015/0273499 A1 * 10/2015 Preston ..... B05B 7/1272 239/412
2016/0228896 A1 * 8/2016 Jones ..... B05B 1/14
2016/0296960 A1 * 10/2016 Diebel ..... B05B 15/55
2017/0170035 A1 * 6/2017 Teng ..... B05B 15/55
2018/0169677 A1 * 6/2018 Lindsay ..... B05B 1/3046

FOREIGN PATENT DOCUMENTS

JP H07-088850 A 4/1995
JP 2008-290023 A 12/2008
JP 2013-040432 A 2/2013
WO 2014/030195 A1 2/2014

* cited by examiner

NOZZLE CAP, NOZZLE DEVICE PROVIDED WITH SUCH CAP, AND SPRAYING METHOD OF CHEMICAL SOLUTION

TECHNICAL FIELD

The present invention relates to a nozzle cap, a nozzle device provided with such a cap and a spraying method of a chemical solution, and also relates to a nozzle cap that hardly causes clogging in a nozzle hole even when used for a long time, and a nozzle device provided with such a nozzle cap and a spraying method of a chemical solution.

BACKGROUND ART

A paper machine is provided with traveling bodies, such as wet paper, wire, felt, press rollers, dryer rollers, canvas, guide rollers, calendar rollers, paper rollers, breaker stack and the like, and by continuously driving these to travel, paper is continuously produced.

In the paper machine, in order to prevent foreign matters derived from pulp material (including waste paper pulp) from adhering to the traveling bodies, and also to improve paper separation of wet paper from the traveling bodies, a chemical solution including chemical agents, such as a washing agent, a pitch control agent, a stain preventive agent, a release agent and the like, is applied to the traveling bodies in the middle of traveling.

Additionally, this chemical solution is generally applied by using a nozzle device attached to each of the traveling bodies.

As such a nozzle device, a nozzle device has been known (see, for example, Patent Literature 1), in which, for example, a nozzle main body, a discharging nozzle that is installed on the upper surface of the nozzle main body and capable of discharging the above-mentioned chemical solution, a first air main body formed on one of side faces of the nozzle main body and provided with a first inner space through which air passes, a first air opening formed on the upper surface of the first air main body by opening the upper portion of the first inner space, a second air main body formed on the other side face of the nozzle main body and provided with a second inner space through which air passes and a second air opening formed on the upper surface of the second air main body by opening an upper portion of the second inner space, with the first air opening and the second air opening being capable of spraying the air, and this structure is characterized in that a through hole by which the first inner space is opened to the outside air is formed on the first air main body and a through hole by which the second inner space is opened to the outside air is formed on the second air main body. Moreover, a nozzle device has been known (see, for example, Patent Literature 2), in which a nozzle main body part having a chemical solution-use nozzle opening capable of discharging a chemical solution, and an air main body part that is capable of spraying air from the two sides of the nozzle main body part in a manner so as to sandwich the discharged chemical solution are installed, and this structure is characterized in that the air main body part is provided with an air introduction flow passage through which air is introduced, a pair of front and rear circulation flow passages that are communicated with the air introduction flow passage and a pair of air-use nozzle openings which are respectively communicated with the circulation flow passages and through which air is discharged, and this nozzle device is characterized in that the cross-sectional area of the air introduction flow passage and the cross-sectional area of the air-use nozzle opening have a predetermined relationship.

In any of these nozzle device, one portion of the nozzle cap on which the nozzle hole is formed has a hollow dome shape, and has a structure in which by allowing air and chemical solution to be flowed into the corresponding nozzle cap, the chemical solution is sprayed.

CITATION LIST

Patent Literature

PTL 1: Japanese Patent Application Laid-Open No. 2008-290023

PTL 2: Japanese Patent Application Laid-Open No. 2013-40432

SUMMARY OF INVENTION

Technical Problem

However, in the nozzle device disclosed in the above-mentioned PTL 1 or PTL 2, the nozzle hole formed on the nozzle cap sometimes causes clogging when used for a long time.

In view of the above-mentioned circumstances, the present invention has been devised, and its object is to provide a nozzle cap that hardly causes clogging in the nozzle hole even when used for a long time, a nozzle device provided with such a nozzle cap and a spraying method of a chemical solution.

Solution to Problems

After having extensively studied so as to solve the above-mentioned problems, inventors of the present invention have considered that in the case when the structure of the nozzle cap has a hollow dome shape, since inflow air is smoothly discharged from the nozzle hole, one portion of the chemical solution inside the nozzle cap is stagnated to be condensed, with the result that clogging is caused in the nozzle hole.

Moreover, they have found that the air cap part and the liquid cap part are designed to form a space part and by providing a structure in which, through the space part, air to be flowed in from the chemical solution spraying air hole is made to collide with the lower surface of a lid part, the above-mentioned problems can be solved; thus, the present invention can be completed.

The present invention relates to (1) a nozzle cap to be used for a nozzle device for spraying a chemical solution to wet paper, wire, felt, press rollers, dryer rollers, canvas or guide rollers in a paper machine, which is provided with: an air cap part that is provided with a first base part having a cylinder shape with a lid, constituted by a lid part and a side wall part, with a nozzle hole that penetrates the first base part being formed substantially in the center of the first base part; and a liquid cap part that is provided with a second base part having a disc-shape with a rib part formed so as to be freely detachably fitted to the first base part and a protruding part which is formed substantially in the center of the second base part so as to protrude toward the first base part side and in which a flow passage for circulating a chemical solution therethrough is formed, and on the second base part, a plurality of chemical solution spraying air holes for circulating air therethrough are formed in a manner so as to surround the protruding part, and in this structure, the chemical solution is flowed from the protruding part to the space part formed between the first base part and the second base part in a state where the first base part and the second base part are fitted to each other, and air is flowed in through the chemical solution spraying air hole so that the chemical solution is sprayed by air from the nozzle hole, and the lower surface of the lid part has a plane shape and the air flowed in from the chemical solution spraying air hole is made to collide with the lower surface of the lid part through the space part.

The present invention relates to the nozzle cap described in the above-mentioned (1) in which (2) a disc shaped small diameter part having a diameter smaller than that of the first base part is formed on the upper surface of the lid part, and the nozzle hole is formed substantially in the center of the first base part and the small diameter part so as to penetrate the first base part and the small diameter part, with the upper surface of the small diameter part being formed into a taper shape so as to recess in the center portion.

The present invention relates to the nozzle cap described in the above-mentioned (1) or (2) in which (3) a circulation part in which a large diameter flow passage for circulating the chemical solution into the flow passage is formed on the lower side of the second base part is installed, with the diameter of the large diameter flow passage being made larger than that of the flow passage.

The present invention relates to the nozzle cap described in any one of the above-mentioned (1) to (3) in which (4) corner portions on the peripheral edge of the nozzle hole on the lower surface of the lid part are chamfered.

The present invention relates to the nozzle cap described in any one of the above-mentioned (1) to (4) in which (5) the shortest distance between the upper end of the protruding part and the lower end of the nozzle hole is set in a range from 0.5 mm to 2.5 mm.

The present invention relates to (6) a nozzle device provided with the nozzle cap described in any one of the above-mentioned (1) to (5), a main body part having a housing hole for housing the nozzle cap and a retainer ring that screws the nozzle cap with the main body part, with its lid part of the nozzle cap inserted into the housing hole being pressed, and in this nozzle device, a main body part flow passage for circulating the chemical solution into the flow passage and a main body part air passage for circulating air into the chemical solution spraying air hole are formed inside the main body part.

The present invention relates to the nozzle device described in the above-mentioned (6) in which (7) on the two sides of the main body part, arm parts for supporting the main body part are installed, and an arm part flow passage for circulating the chemical solution into the main body part flow passage is formed in one of the arm parts and an arm part air passage for circulating air into the main body part air passage is formed in the other arm part.

The present invention relates to the nozzle device described in the above-mentioned (6) or (7) in which (8) before and behind the main body part, air blow parts are formed so that by air blown from the air blow parts, the chemical solution after having been sprayed is pressed down.

The present invention relates to (9) a spraying method for spraying a chemical solution to wet paper, wire, felt, press rollers, dryer rollers, canvas or guide rollers in a paper machine, in which the chemical solution is sprayed, while sliding the nozzle device described in any one of the above-mentioned (6) to (8) in the width direction of the wet paper, wire, felt, press rollers, dryer rollers, canvas or guide rollers.

Advantageous Effects of Invention

In the nozzle cap in accordance with the present invention, since a protruding part is installed on the second base part so as to protrude toward the first base part in a space part between the first base part and the second base part, a chemical solution to be flowed into the space part from the protruding part is discharged onto the first base part side, that is, near the nozzle hole. Thus, the chemical solution is suppressed from stagnating on the second base part side of the space part so that the chemical solution can be easily sprayed from the nozzle hole.

At this time, the shortest distance from the upper end of the protruding part and the lower end of the nozzle hole is desirably set in a range from 0.5 mm to 2.5 mm.

On the other hand, air to be flowed in from the chemical solution spraying air hole is made to collide with the lower surface of the lid part having the plane shape through the space part. Thus, since the air is not smoothly discharged from the nozzle hole, but once diffused inside the space part, the chemical solution hardly stagnates inside the space part, and can be positively sprayed.

By these effects, in accordance with the nozzle cap of the present invention, it becomes possible to hardly cause clogging in the nozzle hole even when used for a long time.

The nozzle cap of the present invention is provided with the air cap part and the liquid cap part, and since the first base part of the air cap part and the second base part of the liquid cap part are designed to be freely detachably attached to each other, only the air cap part can be exchanged on demand, for example, in the case when the diameter of the nozzle hole is desirably changed.

Moreover, since the plural chemical solution spraying air holes for circulating air therethrough are formed on the second base part so as to surround the protruding part, air can be uniformly circulated into the space part.

In the nozzle cap of the present invention, in the case when the small diameter part is formed on the upper surface of the lid part and when the nozzle hole is formed so as to penetrate the first base part and the small diameter part, by forming the upper surface of the small diameter part into a taper shape, with its center being recessed, the chemical solution can be sprayed over a wide range so as to suppress unevenness from being generated. That is, the chemical solution can be sprayed more uniformly.

In the nozzle cap of the present invention, by making the diameter of the large diameter flow passage of the circulation part larger than the diameter of the flow passage, the flow rate of the chemical solution passing through the flow passage can be improved. Thus, it becomes possible to prevent the chemical solution from stagnating inside the flow passage.

In the nozzle cap of the present invention, by chamfering the corner portions of the peripheral edge of the nozzle hole on the lower surface of the lid part, air diffused inside the space part can be easily discharged.

Moreover, it also becomes possible to prevent solid matters of the chemical solution from adhering to the corner portions over time.

Since the nozzle device of the present invention is provided with the above-mentioned nozzle cap, it becomes possible to hardly cause clogging in the nozzle hole even when used for a long time.

Moreover, in the nozzle device of the present invention, since the main body part has the housing hole and since the nozzle cap can be inserted to the corresponding housing hole, by screwing the nozzle cap with a retainer ring, with its lid part of the nozzle cap being pressed, the nozzle cap can be easily attached to the main body part.

Additionally, at this time, positioning of the flow passage and the main body part flow passage, as well as positioning of the chemical solution spraying air hole and the main body part air passage, can be simultaneously carried out at the time of the attaching.

In the nozzle device of the present invention, by installing arm parts on the two sides of the main body part, the nozzle device can be positively supported.

Moreover, by forming the arm part flow passage and the arm part air passage in the arm parts, piping can be simplified.

In the nozzle device of the present invention, by installing air blow parts before and behind the main body part, the chemical solution to be sprayed can be prevented from being scattered by an accompanying flow or the like caused by the traveling of wet paper, wire, felt, press rollers, dryer rollers, canvas or guide rollers.

In the spraying method of a chemical solution of the present invention, since the above-mentioned nozzle device is used, clogging in the nozzle hole is hardly caused even when used for a long time.

Moreover, by spraying the chemical solution while sliding the nozzle device in the width direction of the wet paper, wire, felt, press rollers, dryer rollers, canvas or guide rollers, the chemical solution can be efficiently applied.

DESCRIPTION OF EMBODIMENTS

Figure 1A:
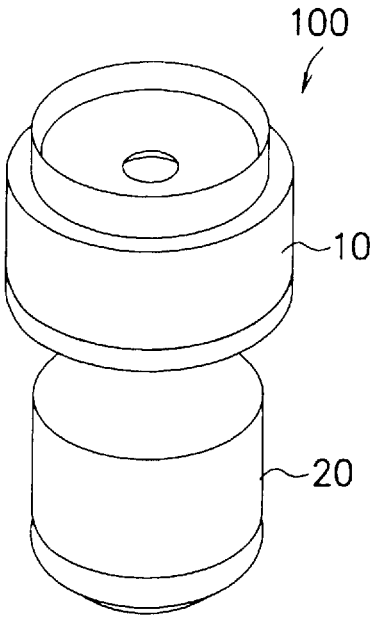
FIG. 1(*a*) is a perspective view showing one embodiment of a nozzle cap relating to the present invention, and FIG. 1(*b*) is a front view thereof.

Referring to Figs. on demand, the following description will explain a preferable embodiment of the present invention in detail. Additionally, in the Figs., the same components are indicated by the same reference numerals, and overlapped explanations will be omitted. Moreover, positional relationships, such as those in longitudinal and lateral directions, are based upon positional relationships indicated by the Figs., without not otherwise specified. Moreover, the dimension ratios of the Figs. are not intended to be limited by the ratios shown in the Figs.

A nozzle cap relating to the present invention is attached to a nozzle device so as to be used for spraying a chemical solution onto traveling wet paper, wires, felt, press rollers, dryer rollers and canvas as well as onto guide rollers for guiding wet paper, wires, felt or a canvas, for example, in a paper machine.

More specifically, it is attached to the tip of the nozzle of a nozzle device so as to be used.

Additionally, the present invention is not particularly limited by the structure of a nozzle device, as long as the nozzle cap relating to the present invention can be attached thereto. Additionally, in the present specification, one example of the nozzle device will be described later.

Moreover, as the chemical solution, a washing agent, a pitch control agent, a stain preventive agent, a release agent or the like can be listed.

First, explanation will be given on one embodiment of the nozzle cap relating to the present invention.

Figure 1B:
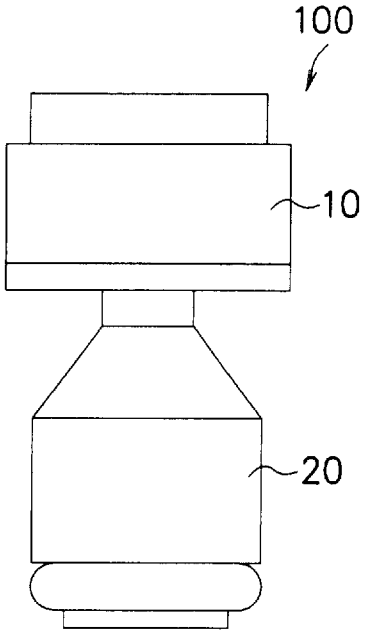

FIG. 1(*a*) is a perspective view showing one embodiment of a nozzle cap relating to the present invention, and FIG. 1(*b*) is a front view thereof.

As shown in FIG. 1(*a*) and FIG. 1(*b*), a nozzle cap 100 is provided with an air cap part 10 and a liquid cap part 20. That is, the nozzle cap 100 has a structure in which the air cap part 10 is fitted to the liquid cap part 20.

Additionally, the air cap part 10 and the liquid cap part 20 are mutually freely detachably attached to each other. More specifically, as will be described later, the first base part of the air cap part 10 and the second base part of the liquid cap part 20 are made to be freely detachably attached to each other. For this reason, for example, in an attempt to change the diameter of the nozzle hole or the like, only the air cap part 10 can be exchanged on demand.

Figure 2A:
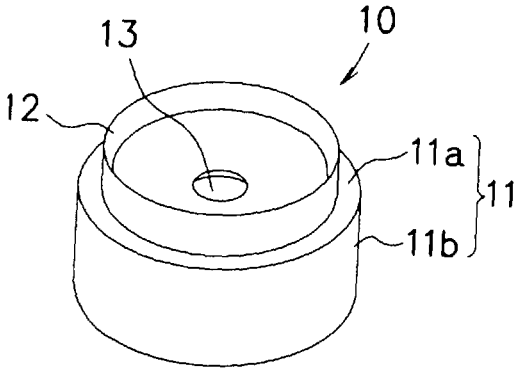
FIG. 2(*a*) is a perspective view showing an air cap part of a nozzle cap relating to the present embodiment, and FIG. 2(*b*) is a perspective view showing a liquid cap part of the nozzle cap relating to the present embodiment.
Figure 2B:
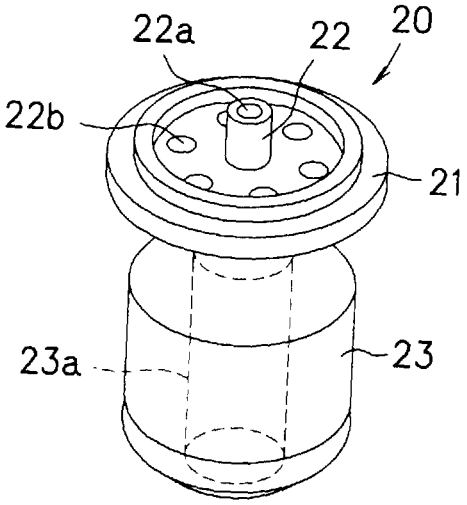

FIG. 2(*a*) is a perspective view showing the air cap part of the nozzle cap relating to the present embodiment, and FIG. 2(*b*) is a perspective view showing the liquid cap part of a nozzle cap relating to the present embodiment. That is, FIG. 2(*a*) and FIG. 2(*b*) respectively show the air cap part 10 and the liquid cap part 20 obtained by disassembling the nozzle cap 100 shown in FIG. 1.

As shown in FIG. 2(*a*), the air cap part 10 is provided with a cylinder-shaped first base part 11 with a lid constituted by a cylinder-shaped side wall part 11*b* and a lid part 11*a* for sealing the upper surface of the side wall part 11*b*, and a small diameter part 12 formed on the upper surface of the lid part 11*a* of the first base part 11.

In the air cap part 10, the first base part 11 and the small diameter part 12 are integrally formed as one unit, and in substantially the center of the first base part 11 and the small diameter part, a nozzle hole 13 that penetrates the first base part 11 and the small diameter part 12 is formed.

In the air cap part 10, the first base part 11 has its inside portion that is surrounded by the side wall part 11*b* and the lid part 11*a* made hollow, and by sealing the bottom side with a second base part to be described later, a space part to be described later is formed.

Figure 3:
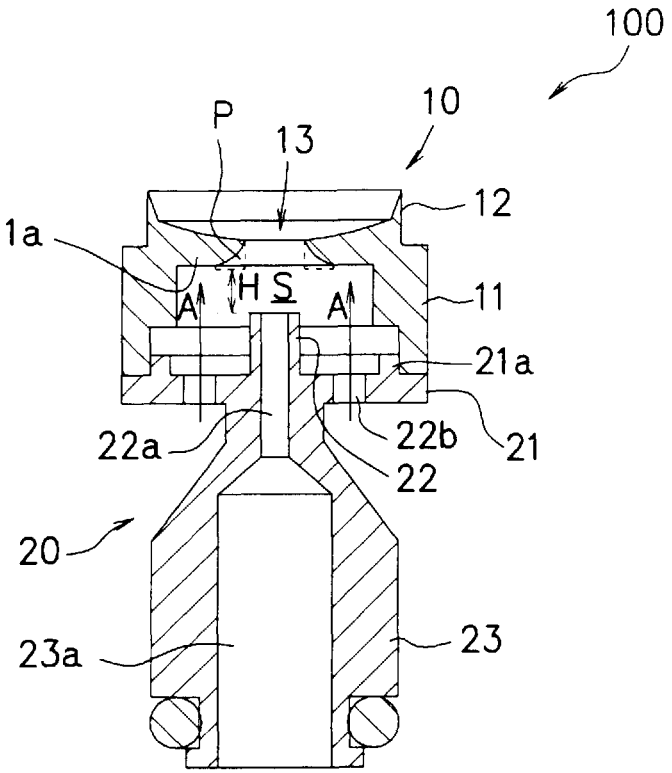
FIG. 3 is a vertical cross-sectional view showing the nozzle cap relating to the present embodiment.

Moreover, the small diameter part 12 has its diameter formed into a disc shape having a diameter smaller than the diameter of the first base part, and the upper surface of the small diameter part 12 has a taper shape, with its center portion being recessed downward (see FIG. 3). That is, the upper surface of the small diameter part 12 is uniformly tilted downward from the periphery of the small diameter part 12 toward the inside, and a nozzle hole 13 is formed in the most recessed center portion. In this manner, in the nozzle cap 100, since the upper surface of the small diameter part 12 is formed into the taper shape, the chemical solution can be uniformly sprayed radially. However, in the case where the upper surface is not formed into the taper shape, when the chemical solution is sprayed radially, its concentration in the center portion tends to become higher, while the concentration on the peripheral portion tends to become lower.

As shown in FIG. 2(*b*), the liquid cap part 20 is provided with a disc-shaped second base part 21 and a protruding part 22 that is formed substantially in the center of the second base part 21 so as to protrude toward the first base part 11 side.

In the liquid cap part 20, inside the protruding part 22, a flow passage 22*a* for circulating a chemical solution therethrough is formed. Therefore, the chemical solution to flow through the flow passage 22*a* of the protruding part 22 is discharged into a space part to be described later.

Moreover, on the lower side of the second base part 21, a circulation part 23 in which a large diameter flow passage 23*a* for circulating the chemical solution into the flow passage 22*a* is formed is installed. Additionally, the corresponding large diameter flow passage 23*a* has its diameter set to be larger than the diameter of the flow passage 22*a*. Thus, since the flow rate of the chemical solution flowing through the flow passage 22*a* becomes greater than the flow rate of the chemical solution flowing through the large diameter flow passage 23*a*, it becomes possible to prevent the chemical solution from stagnating inside the flow passage 22*a*.

In the second base part 21, a ring-shaped rib part 21*a* to be fitted to the first base part 11 is formed on its upper surface (surface on the first base part 10 side). That is, by allowing the side wall part 11*b* of the first base part 11 to be fitted to the rib part 21*a*, the air cap part 10 (first base part 11) and the liquid cap part 20 (second base part 21) are fitted to each other.

In the liquid cap part 20, on the second base part 21, a plurality of chemical solution spraying air holes 22*b* for circulating air are formed between the rib part 21*a* and the protruding part 22.

All these plural chemical solution spraying air holes 22*b* have the same size and the same shape, and are disposed so as to surround the protruding part with respectively uniform intervals. Thus, it becomes possible to circulate air uniformly into a space part to be described later.

Additionally, in the case when the air cap part 10 and the liquid cap part 20 are fitted to each other, one side of the chemical solution spraying air hole 22*b* is communicated with a space part to be described later and the other side thereof is communicated with the outside of the nozzle cap 100.

FIG. 3 is a vertical cross-sectional view showing a nozzle cap relating to the present embodiment.

As shown in FIG. 3, in the nozzle cap 100, a space part S is formed between the first base part 11 and the second base part 21, with the air cap part 10 and the liquid cap part 20 being fitted to each other.

In the space part S, the chemical solution is flowed in from the flow passage 22*a* of the protruding part 22, and air is flowed in from the chemical solution spraying air holes 22*b*.

Thus, in the nozzle cap 100, the space part S is pressurized by the air flowed therein so that the chemical solution is pushed outward from the nozzle hole 13 together with the air so that the chemical solution is sprayed.

In the nozzle cap 100, as described above, since the protruding part 22 is formed so as to protrude from the second base part 21 toward the first base part 11, the chemical solution to be flowed into the space part S from the protruding part 22 is discharged comparatively near the nozzle hole 13. Thus, it is possible to suppress the chemical solution from stagnating on the second base part 21 of the space part S and consequently to efficiently spray the chemical solution from the nozzle hole 13.

Additionally, the shortest distance H from the upper end of the protruding part 22 and the lower end of the nozzle hole 13 is preferably set in a range from 0.5 mm to 2.5 mm, more preferably set in a range from 0.8 mm to 2.0 mm, and most preferably set in a range from 1.0 mm to 1.9 mm.

In the case when the shortest distance H is less than 0.5 mm, in addition to the fact that the chemical solution having a sufficient amount is not sprayed in comparison with the case in which the shortest distance H is set in the above-mentioned range, because of an insufficient pressure applied to the nozzle hole 22*a*, another disadvantage in that the spraying process is intermittently carried out is raised, while in the case when the shortest distance H exceeds 2.5 mm, the chemical solution stagnated in the space part might be solidified in comparison with the case in which the shortest distance H is within the above-mentioned range. Additionally, in the case when the shortest distance H is set from 1.0 mm to 1.9 mm, a more stable spraying operation can be carried out.

As indicated by an arrow A, air to be flowed in from the chemical solution spraying air holes 22*b* is designed to collide with the lower surface having a plane shape of the lid part 11*a* through the space part. That is, each spraying air hole 22*b* is formed so as to be deviated from the nozzle hole 13 so that the direction of air to be flowed in is not straightly led to the nozzle hole 13, but designed so as to collide with the lower surface of the lid part 11*a*. In this manner, since the air collides with the lower surface of the lid part 11*a*, the air, as it is, is not discharged from the nozzle hole 13, but is once diffused inside the space part S. As a result, the air is distributed to each of the corners inside the space part S, thereby making it possible to prevent the chemical solution from partially stagnating.

In this case, in the nozzle cap 100, corner portions P on the peripheral edge of the nozzle hole 13 on the lower surface of the lid part 11*a* are chamfered. More specifically, it is preferably R chamfered. Additionally, in FIG. 3, the corner portion P prior to being chamfered is indicated by a broken line. Thus, air diffused inside the space part S is easily discharged from the nozzle hole 13 so that solid matters of the chemical solution are also prevented from adhering to the corner portions P over time.

With these arrangements, in the nozzle cap 100 relating to the present embodiment, by allowing the chemical solution to be discharged near the nozzle hole 13 in the space part S, and by also diffusing air inside the space part S, it becomes possible to hardly cause clogging in the nozzle hole, even when used for a long time.

Next, explanation will be given on the nozzle device provided with the above-mentioned nozzle cap 100.

Figure 4:
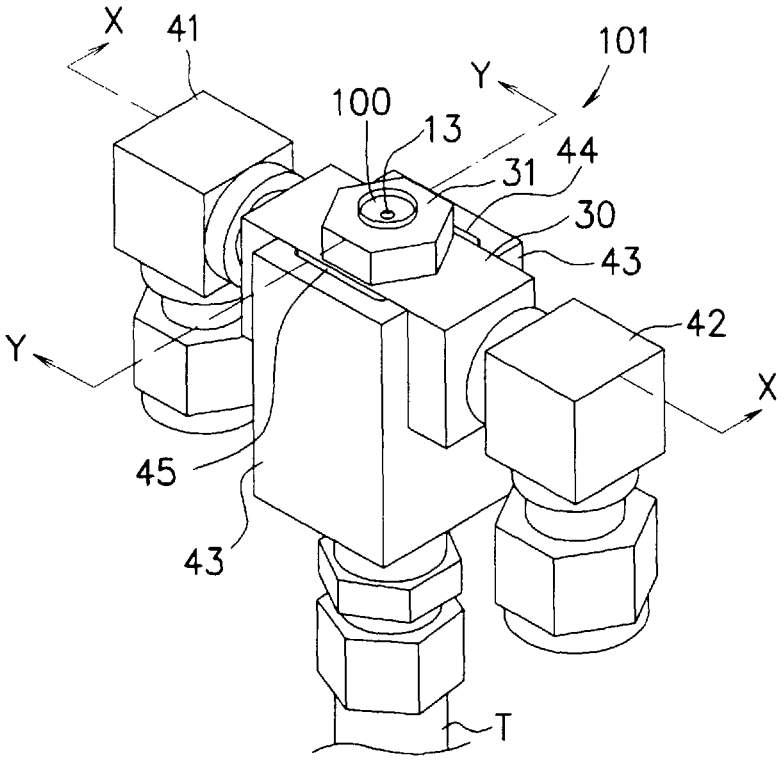
FIG. 4 is a perspective view showing one embodiment of a nozzle device relating to the present embodiment.

FIG. 4 is a perspective view showing one embodiment of a nozzle device relating to the present invention.

As shown in FIG. 4, a nozzle device 101 relating to the present embodiment is provided with the above-mentioned nozzle cap 100, a main body part 30 capable of housing the corresponding nozzle cap 100, a retainer ring 31 for fixing the nozzle cap 100 onto the main body part 30, a pair of arm parts 41 and 42 that are installed on the two sides of the main body part 30 so as to support the main body part 30 and air blow parts 43 formed before and behind the main body part 30.

Since the nozzle device 101 is provided with the above-mentioned nozzle cap 100, clogging in the nozzle hole 13 is hardly caused, even when used for a long time.

In the nozzle device 101, the nozzle cap 100 is attached to the upper center portion of the main body part 30.

Figure 5:
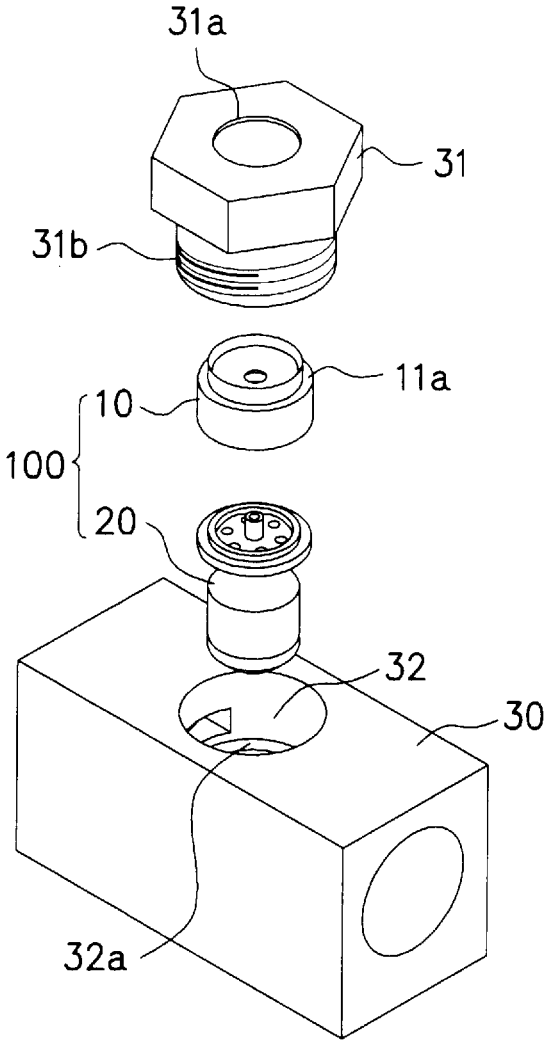
FIG. 5 is a partial perspective view for use in explaining a state in which the nozzle cap is attached to a main body part in the nozzle device relating to the present embodiment.

FIG. 5 is a partial perspective view for use in explaining a state in which in the nozzle device relating to the present embodiment, the nozzle cap is attached to the main body part.

As shown in FIG. 5, the main body part 30 is provided with a housing hole 32 for housing the nozzle cap 100. Moreover, onto the housing hole 32, a female screw part 32*a* is formed.

Figure 6:
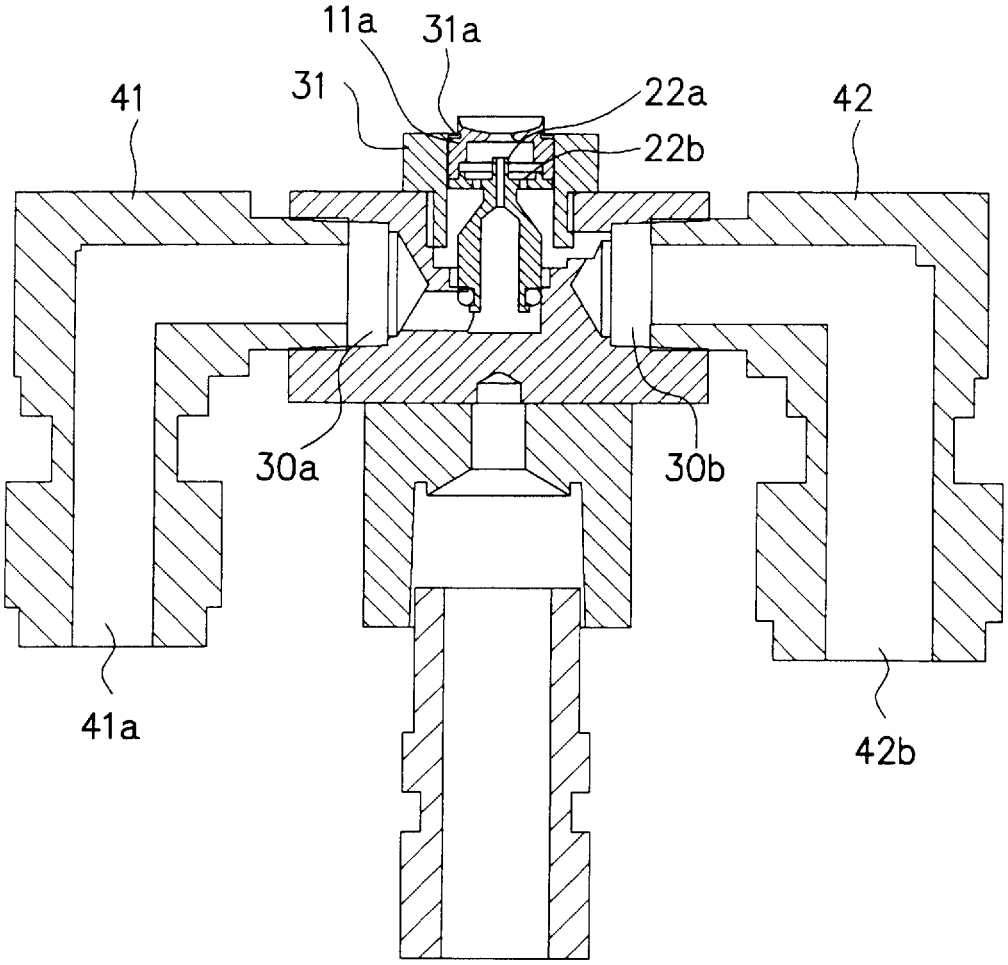
FIG. 6 is a vertical cross-sectional view taken along line X-X of the nozzle device shown in FIG. 4.

On the other hand, the retainer ring 31 has a ring shape, and a protruding portion 31*a* that protrudes inward is formed on the upper end (see FIG. 6). Moreover, a male screw part 31*b* is formed on the retainer ring 31.

Furthermore, the nozzle cap 100 is inserted into the housing hole 32 of the main body part 30, and by putting the retainer ring 31 thereon so as to be pressed therein, the protruding portion 31*a* of the retainer ring 31 pushes the upper surface of the lid part 11*a* of the nozzle cap 100 downward.

In this state, by screwing the male screw part 31*b* of the retainer ring 31 and the female screw part 32*a* of the housing hole 32 with each other, the nozzle cap 100 is attached in a state where the nozzle cap 100 is positionally fixed onto the housing hole 32 of the main body part 30.

At this time, since the nozzle cap 100 is position-determined, the large diameter flow passage 23*a* of the nozzle cap 100 is coincident with a main body part flow passage 30*a* of the main body part 30 to be described later, and the chemical solution spraying air hole 22*b* of the nozzle cap 100 is also coincident with a main body air passage 30*b* of the main body 30 to be described later.

As shown again in FIG. 4, in the nozzle device 101, arm parts 41 and 42 having an L-letter shape when seen in a side view are attached onto its two sides.

FIG. 6 is a vertical cross-sectional view taken along line X-X of the nozzle device shown in FIG. 4.

As shown in FIG. 6, the nozzle device 101 is provided with the main boy part flow passage 30*a* for circulating the chemical solution into the flow passage 22*a* and the main body part air passage 30*b* for circulating air into the chemical solution spraying air hole 22*b*, which are formed inside the main body part 30.

Moreover, in one of the arm parts 41, an arm part flow passage 41*a* for circulating the chemical solution into the main body part flow passage 30*a* is formed, and in the other arm part 42, an arm part air passage 42*b* for circulating air into the main body part air passage 30*b* is formed.

In this manner, in the nozzle device 101, by forming the arm part flow passage 41*a* and the arm part air passage 42*b* in the arm parts 41 and 42, the piping can be simplified.

Additionally, onto the end portion of one of the arm parts 41, a tube, not shown, is attached, and the arm part flow passage 41*a* is connected to a chemical solution supply source, not shown, through the corresponding tube.

Moreover, onto the end portion of the other arm part 42, a tube, not shown, is attached, and the arm part air passage 42*b* is connected to an air supply source, not shown, through the corresponding tube.

As shown again in FIG. 4, in the nozzle device 101, an air blow part 43 having a U-letter shape when seen in a side view is attached in a manner so as to sandwich the main body part 30 from below the main body part 30. Thus, blow-use air holes 44 and 45 are formed before and behind the main body part 30. More specifically, gaps between the outer side face of the main body part 30 and the air blow part 43 form blow-use air holes 44 and 45.

Additionally, onto the lower end portion of the air blow part 43, a tube T is attached so that the air flow passage inside the air blow part 43 is connected to an air supply source, not shown, through the corresponding tube T.

Figure 7:
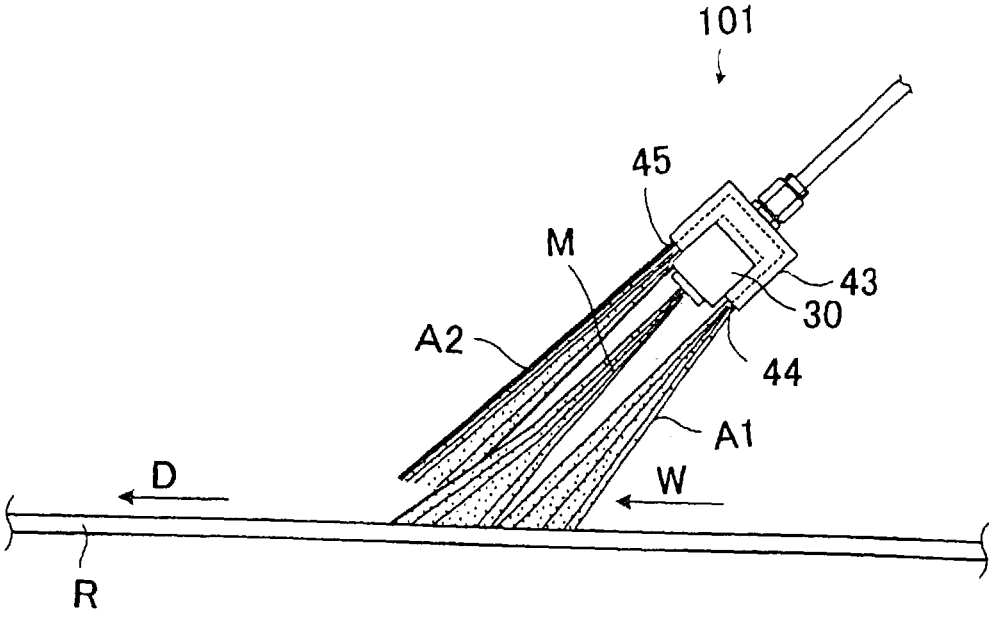
FIG. 7 is a schematic perspective view showing a state in which a chemical solution and air are sprayed to traveling bodies from the nozzle device relating to the present embodiment.

FIG. 7 is a schematic view showing a state in which a chemical solution and air are sprayed onto traveling bodies from the nozzle device relating to the present embodiment. Additionally, the nozzle device shown in FIG. 7 is indicated in a schematic view of a vertical cross-section taken along line Y-Y of the nozzle device shown in FIG. 4.

As shown in FIG. 7, in the nozzle device 101, a pair of blow-use air holes 44 and 45 are arranged in one row along a traveling direction D of traveling bodies R.

Moreover, in the nozzle device 100, air A1 blown from the blow-use air hole 44 on the upstream side is further blown onto the upstream side of chemical solution M so that one portion of an accompanying flow W is blocked.

On the other hand, air A2 blown from the blow-use air hole 45 on the downstream side is further blown onto the downstream side of chemical solution M so that scattering of the chemical solution M caused by the accompanying flow W is prevented.

In this manner, even in the case when the traveling bodies R travel at a high speed, since the chemical solution after having been sprayed is suppressed by the air sprayed from the air blow part 43 so that it becomes possible to positively apply the chemical solution M onto the traveling bodies R against the accompanying flow W.

Next, explanation will be given on the spraying method of the chemical solution by using the above-mentioned nozzle device 101.

Figure 8:
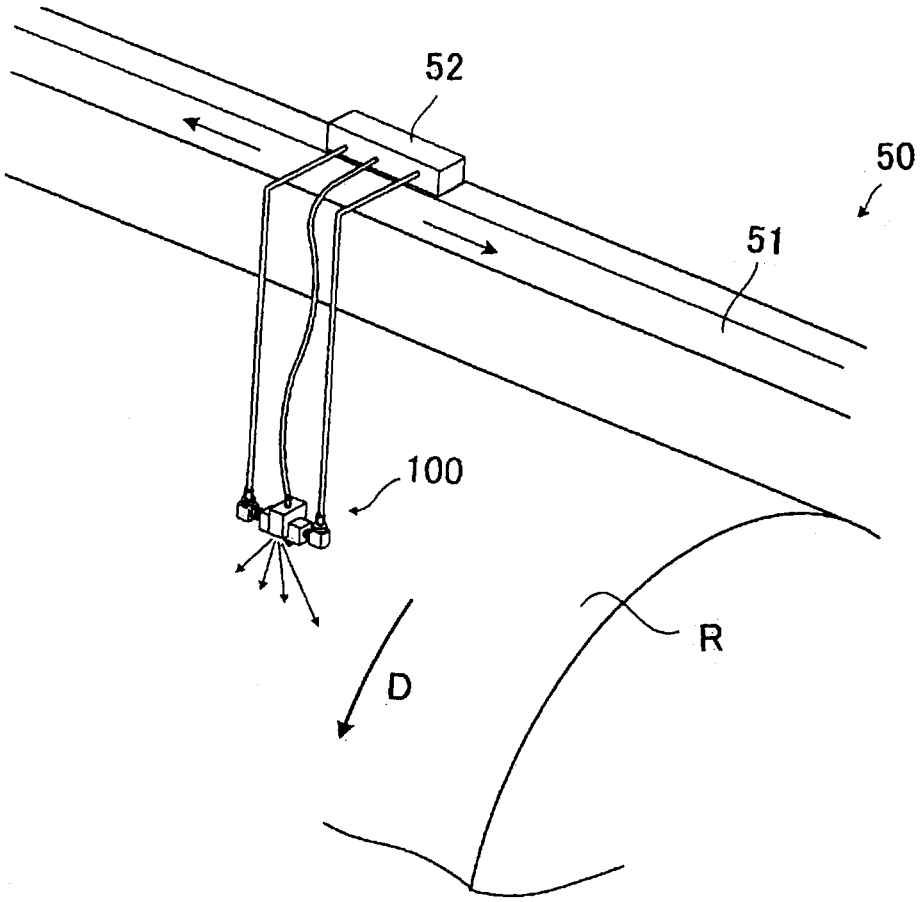
FIG. 8 is a schematic perspective view for explaining a spraying method of a chemical solution by the use of the nozzle device relating to the present invention.

FIG. 8 is a schematic perspective view for use in explaining the spraying method of the chemical solution by using the nozzle device relating to the present invention.

As shown in FIG. 8, the paper machine is provided with the traveling bodies R, and a spraying device 50 is attached to each of the traveling bodies R.

Additionally, as the traveling bodies R, wet paper, wire, felt, press rollers, dryer rollers, canvas, guide rollers, calendar rollers, paper rollers, breaker stack and the like are listed. Among these, the traveling bodies R are preferably prepared as wet paper, wire, felt, press rollers, dryer rollers, canvas or guide rollers. Since these traveling bodies R travel at high speeds and also require the application of a chemical solution, effects by the nozzle cap can be further exerted.

In the spraying method of the chemical solution, spraying of the chemical solution is carried out onto the traveling bodies R that travel in a traveling direction D by using the spraying device 50.

In this case, the spraying device 50 is provided with a rail 51 supported onto a frame, not shown, a driving device 52 that reciprocally moves toward longitudinal directions of the corresponding rail, and the nozzle device 101 that is attached to the driving device 52 with support pipes interposed therebetween.

Therefore, in the spraying method of the chemical solution, the chemical solution is sprayed toward the traveling bodies R that travel toward traveling directions D, while sliding the nozzle device 101 in the width directions of the traveling bodies R along the rail 51.

In accordance with the spraying method of a chemical solution relating to the present embodiment, since the above-mentioned nozzle device 101 is used, clogging in the nozzle hole is hardly caused even when used for a long time.

Moreover, by spraying the chemical solution while carrying out the sliding in width directions of the traveling bodies R, it becomes possible to apply the chemical solution efficiently.

Explanation has been given on preferred embodiments of the present invention; however, the present invention is not intended to be limited by the above-mentioned embodiments.

In the nozzle cap 100 relating to the present embodiment, the small diameter part 12 is installed on the upper surface of the lid part 11*a* of the first base part 11; however, this structure is not necessarily required.

Additionally, in the case when the small diameter part 12 is not installed, a nozzle hole that penetrates the first base part 11 is formed substantially in the center of the first base part 11.

Moreover, the first base part 11 and the small diameter part 12 are integrally formed as one unit; however, these may be formed as different members.

In the nozzle cap 100 relating to the present embodiment, the upper surface of the small diameter part 12 has a taper shape, with its center being recessed downward; however, this structure is not necessarily required.

In the nozzle cap 100 relating to the present embodiment, six chemical solution spraying air holes 22*b* are formed between the rib part 21*a* of the second base part 21 and the protruding part 22; however, the number of holes to be formed is not particularly limited. Moreover, the mutually adjacent chemical solution spraying air holes may be connected with each other by slits or the like formed on the second base part.

Moreover, all the plural chemical solution spraying air holes 22*b* have the same size and the same shape, and are disposed so as to surround the protruding part, with respectively uniform intervals; however, this arrangement is not necessarily required.

INDUSTRIAL APPLICABILITY

The nozzle cap relating to the present invention is attached to a nozzle device so as to be used for spraying a chemical solution onto traveling wet paper, wires, felt, press rollers, dryer rollers, canvas, or guide rollers, for example, in a paper machine.

The nozzle device relating to the present invention is used as a device for spraying a chemical solution onto wet paper, wires, felt, press rollers, dryer rollers, canvas, or guide rollers in a paper machine.

The spraying method of a chemical solution relating to the present invention is used as a method for spraying a chemical solution onto wet paper, wires, felt, press rollers, dryer rollers, canvas, or guide rollers in a paper machine.

In accordance with the nozzle cap, the nozzle device provided therewith and the spraying method of a chemical solution, clogging in a nozzle hole is hardly caused even when used for a long time.

REFERENCE SIGNS LIST

10 . . . air cap part,
100 . . . nozzle cap,
101 . . . nozzle device,
11 . . . first base part,
11*a* . . . lid part,
11*b* . . . side wall part,
12 . . . small diameter part,
13 . . . nozzle hole,
20 . . . liquid cap part,
21 . . . second base part,
21*a* . . . rib part,
22 . . . protruding part,
22*a* . . . flow passage,
22*b* . . . chemical solution spraying air hole,
23*a* . . . large diameter flow passage,
30 . . . main body part,
30*a* . . . main body part flow passage,
30*b* . . . main body part air passage,
31 . . . retainer ring,
31*a* . . . protruding portion,
31*b* . . . male screw part,
32 . . . housing hole,
32*a* . . . female screw part,
41, 42 . . . a rm part,
41*a* . . . arm part flow passage,
42*b* . . . arm part air passage,
43 . . . air blow part,
44, 45 . . . blow-use air hole,
50 . . . spraying device,
51 . . . rail,
52 . . . driving device,
A1, A2 . . . air,
D . . . traveling direction,
H . . . shortest distance,
M . . . chemical solution,
P . . . corner portion,
R . . . traveling body,
S . . . space part,
T . . . tube,
W . . . accompanying flow

The invention claimed is:

1. A nozzle cap to be used for a nozzle device for spraying a chemical solution to wet paper, wire, felt, press rollers, dryer rollers, canvas or guide rollers in a paper machine, comprising:

an air cap part that is provided with a first base part having a cylinder shape, the first base being constituted by a lid part and a side wall part wherein a nozzle hole that penetrates the first base part is formed substantially in the center of the first base part; and a liquid cap part that is provided with a second base part having a disc-shape with a rib part formed so as to be freely detachably fitted to the first base part and a protruding part which is formed substantially in the center of the second base part so as to protrude toward the first base part wherein a flow passage for circulating a chemical solution therethrough is formed in the protruding part, and a plurality of chemical solution spraying air holes for circulating air therethrough are formed on the second base part in a manner so as to surround the protruding part, wherein a space is formed between the first base part and the second base part by the first base part and the second base part being fitted to each other, a chemical solution is flowed in the space from the protruding part, and air is flowed in the space from the chemical solution spraying air holes so that the chemical solution from the nozzle holes is sprayed by the air from the space, the lid part has a lower surface having a plane shape and an upper surface that faces in an opposite direction from the lower surface, a small diameter part is formed on the upper surface of the lid part wherein the small diameter part has a disc shape with a diameter that is smaller than that of the first base part, and is disposed substantially in the center of the first base part and the small diameter part, the nozzle hole is formed so as to penetrate the first base part and the small diameter part, the upper surface of the lid part is formed into a taper shape so as to be recessed in the center, the air flowed in the space through the chemical solution spraying air holes is made to collide with the lower surface of the lid part through the space.

2. The nozzle cap according to claim 1, wherein a circulation part in which a large diameter flow passage for circulating the chemical solution into the flow passage is formed on the lower side of the second base part is installed, with the diameter of the large diameter flow passage being made larger than the diameter of the flow passage.

3. The nozzle cap according to claim 1, wherein corner portions on the peripheral edge of the nozzle hole on the lower surface of the lid part are chamfered.

4. The nozzle cap according to claim 1, wherein the shortest distance between the upper end of the protruding part and the lower end of the nozzle hole is set in a range from 0.5 mm to 2.5 mm.

5. A nozzle device comprising:

the nozzle cap according to claim 1;

a main body part having a housing hole for housing the nozzle cap; and a retainer ring capable of screwing the nozzle cap with the main body part, with the lid part of the nozzle cap inserted to the housing hole being pressed, wherein a main body part flow passage for circulating the chemical solution into the flow passage and a main body part air passage for circulating air into the chemical solution spraying air hole are formed inside the main body part.

6. The nozzle device according to claim 5, wherein on the two sides of the main body part, arm parts for supporting the main body part are installed, and an arm part flow passage for circulating the chemical solution into the main body part flow passage is formed in one of the arm parts and an arm part air passage for circulating air into the main body part air passage is formed in the other arm part.

7. The nozzle device according to claim 5, wherein before and behind the main body part, air blow parts are formed so that by air blown from the air blow parts, the chemical solution after having been sprayed is pressed down.

8. A spraying method for spraying a chemical solution to wet paper, wire, felt, press rollers, dryer rollers, canvas or guide rollers in a paper machine, wherein the chemical solution is sprayed, while sliding the nozzle device according to claim 5 in the width direction of the wet paper, wire, felt, press rollers, dryer rollers, canvas or guide rollers.

* * * * *